US009674910B1

(12) United States Patent
Shih et al.

(10) Patent No.: US 9,674,910 B1
(45) Date of Patent: Jun. 6, 2017

(54) FILAMENT SIMULATION CIRCUIT FOR LED TUBE

(71) Applicant: Alfasemi Inc., Taipei (TW)

(72) Inventors: Te-Lung Shih, Taipei (TW); Yu-Cheng Chang, Cupertino, CA (US)

(73) Assignee: ALFASEMI INC. (TW)

( * ) Notice: Subject to any disclaimer, the term of this patent is extended or adjusted under 35 U.S.C. 154(b) by 0 days.

(21) Appl. No.: 15/187,874

(22) Filed: Jun. 21, 2016

(51) Int. Cl.
*F21V 21/00* (2006.01)
*H05B 33/08* (2006.01)
*F21K 9/278* (2016.01)

(52) U.S. Cl.
CPC ..... *H05B 33/0824* (2013.01); *F21K 9/278* (2016.08); *H05B 33/0842* (2013.01)

(58) Field of Classification Search
CPC ..... F21K 9/27; F21K 9/272
USPC ..... 362/217.01; 315/51, 71, 185 R
See application file for complete search history.

(56) References Cited

U.S. PATENT DOCUMENTS 8,358,056 B2 * 1/2013 Park ..... H05B 33/0803 313/498
8,896,207 B2 * 11/2014 Thomas ..... H05B 33/0809 315/185 R
9,526,133 B2 * 12/2016 Tao ..... H05B 37/02

* cited by examiner

*Primary Examiner* — Thuy Vinh Tran
(74) *Attorney, Agent, or Firm* — Bacon & Thomas, PLLC

(57) ABSTRACT

A filament simulation circuit for LED tube, comprising: two filament simulation parts respectively disposed on two terminals of a tube to receive a current from an electronic ballast, each filament simulation part including two sub-filament simulation parts, each sub-filament simulation part including a first resistor, a capacitor and a inductor, wherein each sub-filament simulation part is divided into: a first part; and a second part connected in series to the first part, the second part having a parallel connection structure; wherein an impedance of the sub-filament simulation part in a pre-heated stage is greater than that in an operating stage.

18 Claims, 5 Drawing Sheets

FILAMENT SIMULATION CIRCUIT FOR LED TUBE

BACKGROUND OF THE INVENTION

1. Field of the Invention

The present invention relates to a filament simulation circuit and, more particularly, to a filament simulation circuit for LED tube.

2. Description of Related Art

Currently, when using an LED tube to replace a conventional fluorescent lamp, it is necessary to add some resistors into the LED tube to simulate filaments, as shown in FIG. 1(A), so as to allow an electronic ballast to correctly identify the type of the LED tube. However, due to that the electronic ballast outputs an AC power when the LED tube is in operation (illumination), the AC power is consumed on the resistors, resulting in degrading the efficiency of the LED tube. Besides, because high temperature will be generated when current is applied to a pure resistor circuit, there is a must to add an additional heat dissipation mechanism and to increase the power of the resistor for corresponding to the consumed power, resulting in a high manufacturing cost.

To overcome the aforementioned problem, a direct approach is to replace the resistors with AC impedance devices (such as pure capacitors or pure inductors) so as to reduce the power consumption, as shown in FIGS. 1(B) and 1(C). However, this approach may encounter another problem that the electronic ballast which outputs DC power in an identifying stage being unable to identify the LED tube based on the resistance, resulting in an error.

Therefore, there is a need to provide an improved filament simulation circuit for LED tube so as to solve the aforementioned problems.

SUMMARY OF THE INVENTION

An object of the present invention is to provide a filament simulation circuit for LED tube, which comprises: two filament simulation parts respectively disposed on two terminals of a tube to receive a current from an electronic ballast, each filament simulation part including two sub-filament simulation parts, each sub-filament simulation part including a first resistor, a capacitor and a inductor, wherein each sub-filament simulation part is divided into: a first part; and a second part connected in series to the first part, the second part having a parallel connection structure; wherein an impedance of the sub-filament simulation part in a pre-heated stage is greater than that in an operating stage. Thus, because the filament simulation circuit of the invention is provided with the resistor, capacitor and the inductor at the same time, it can be suitable for different types of electronic ballasts in the identifying stage. Besides, in the operating stage, the total power consumption can be lowered and the high temperature generated by the resistor can be reduced due to the operation of the capacitor and the inductor.

DETAILED DESCRIPTION OF THE PREFERRED EMBODIMENT

Figure 1A:
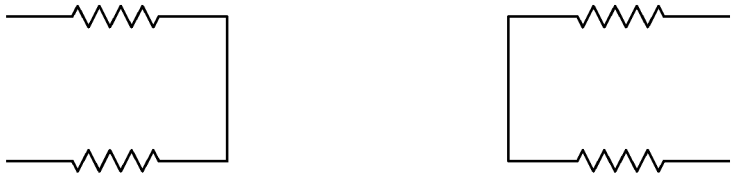
FIG. 1(A) (PRIOR ART)
FIGS. 1(A) to 1(C) are schematic diagrams illustrating the structure of the prior filament simulation circuit.
Figure 1B:
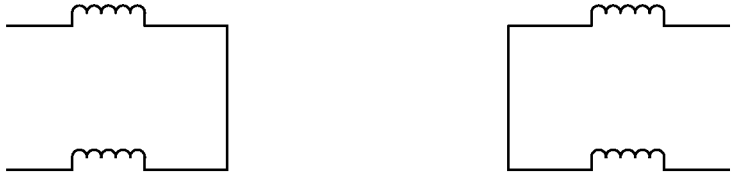
FIG. 1(B) (PRIOR ART)
Figure 1C:
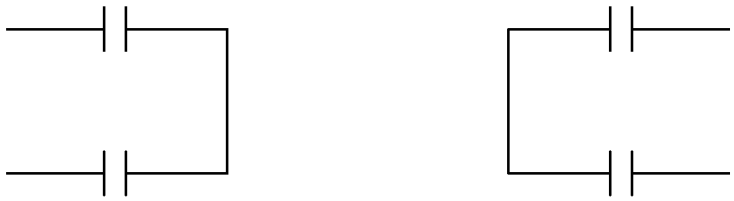
FIG. 1(C) (PRIOR ART)
Figure 2:
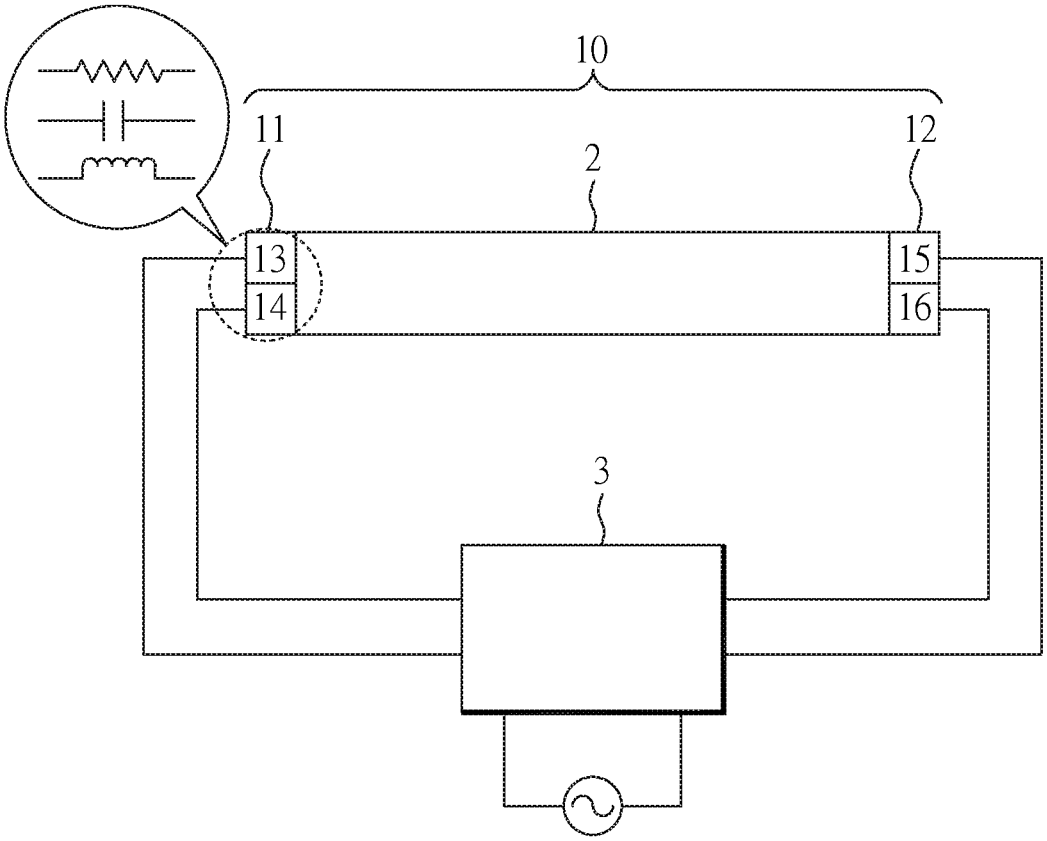
FIG. 2 is a schematic diagram illustrating a main structure of a filament simulation circuit according to an embodiment of the invention.

FIG. 2 is a schematic diagram illustrating a main structure of a filament simulation circuit 10 according to an embodiment of the invention. The filament simulation circuit 10 includes a first filament simulation part 11 disposed on a terminal of an LED tube 2 and a second filament simulation part 12 disposed on the other terminal of the LED tube 2. When the LED tube 2 is installed in a lamp holder, the first filament simulation part 11 and the second filament part 12 are respectively connected to an electronic ballast 3, so as to receive a current from the electronic ballast 3. The first filament simulation part 11 and the second filament simulation part 12 are preferably but not limited to be of the same circuit structure. The first filament simulation part 11 includes a first sub-filament simulation part 13 and a second sub-filament simulation part 14 connected in series to the sub-filament simulation part 13. Similarly, the second simulation part 12 includes a third sub-filament simulation part 15 and a fourth sub-filament simulation part 16 connected in series to the third sub-filament simulation part 15.

Besides, in one embodiment, the first sub-filament simulation part 13, the second sub-filament simulation part 14, the third sub-filament part 15 and the fourth sub-filament simulation part 16 are preferred but not limited to be of the same structure. Each sub-filament simulation part is composed of at least a resistor, and/or a capacitor and an inductor.

In practice, when the lamp holder is powered on, the electronic ballast 3 identifies the type of the LED tube 2, and then outputs a corresponding power to turn on the LED tube 2 for illumination. In one embodiment, the electronic ballast 3 identifies the LED tube 2 according to the impedance from the first filament simulation part 11 or the second filament simulation part 12.

Generally, different kinds of electronic ballast 3 output different types of current in an identifying stage. For example, some electronic ballast 3 outputs direct current in the identifying stage and identifies the LED tube 2 according to the resistance of the filament, and some electronic ballast 3 outputs alternating current and identifies the LED tube 2 according to a current value corresponding to the impedance of the filament. Thus, for a general filament circuit composed of resistors only, it is not suitable for the electronic ballast 3 that outputs the alternating current. Advantageously, the filament simulation circuit 10 of the invention includes both of the direct current impedance device and the alternating current impedance device so as to solve the said problem, thereby enabling the LED tube 2 to be suitably operated on any type of the electronic ballast 3.

Besides, after the identifying stage, the output of the electronic ballast 3 can be divided into a pre-heated stage and a steady output stage (i.e. an operating stage). The electronic ballast 3 outputs alternating current in the pre-heated stage and the operating stage, and a frequency of the alternating current from the electronic ballast in the pre-heated stage is higher than that in the operating stage normally. But in the other embodiment, it has a different operating type that the alternating current is keep in same frequency.

Figure 3A:
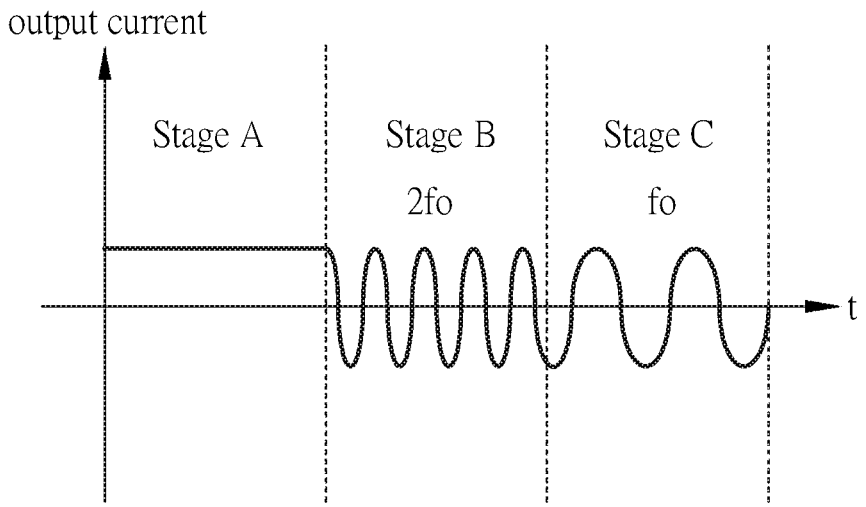
FIG. 3(A) is a schematic diagram illustrating an outputting signal from a first type of the electronic ballast.

FIG. 3(A) is a schematic diagram illustrating the outputting signal from a first type of the electronic ballast 3. With reference to FIG. 3(A) and FIG. 2, in the identifying stage (stage A), the electronic ballast 3 outputs direct current. In an embodiment, when in the pre-heated stage (stage B), the output of the electronic ballast 3 is changed to alternating current with a frequency of 2fo. When in the operating stage (stage C), the electronic ballast 3 still outputs alternating current, but the frequency of the alternating current is lowered to be fo. In the identifying stage (stage A), the first type of the electronic ballast 3 can identify the LED tube 2 according to the resistance of the resistors in the filament simulation circuit 10 through which the direct current flows.

Figure 3B:
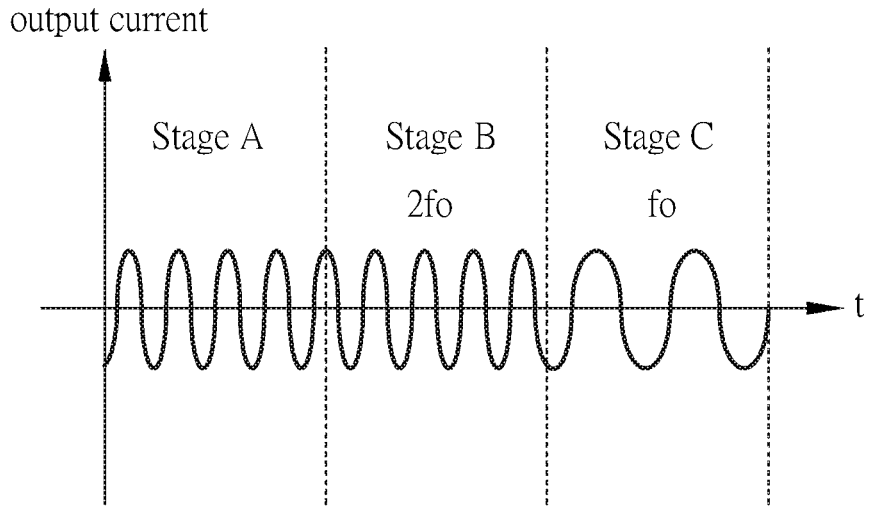
FIG. 3(B) is a schematic diagram illustrating an outputting signal from a second type of the electronic ballast.

FIG. 3(B) is a schematic diagram illustrating the output from a second type of the electronic ballast 3. With reference to FIG. 3(B) and FIG. 2, in the identifying stage (stage A), the electronic ballast 3 outputs an alternating current, and in the pre-heated stage (stage B), the electronic ballast 3 keeps outputting the same alternating current. In the operating stage (stage C), the frequency of the alternating current from the electronic ballast 3 is decreased. In the identifying stage (stage A), the resistors and the alternating current devices (the capacitors and inductors) in the filament simulation circuit 10 constitute an impedance, so that the second type of the electronic ballast 3 can identify the LED tube 2 according to a current value corresponding to the impedance.

With the filament simulation circuit 10 having both of the resistor and the alternating current devices, the LED tube 2 with the filament simulation circuit 1 can be properly adapted to any type of the electronic ballast 3, thereby reducing the production cost.

Figure 4A:
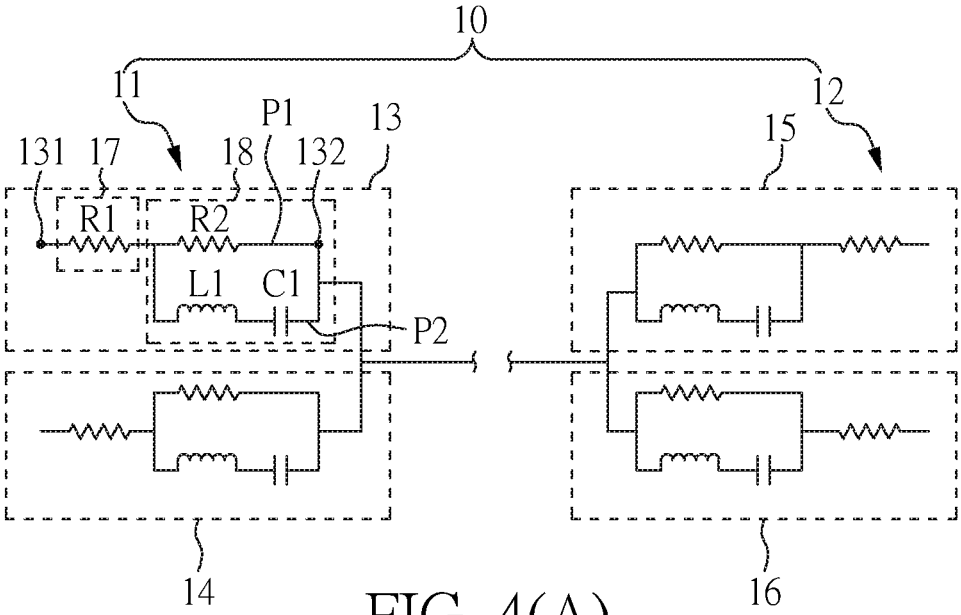
FIG. 4(A) is a detailed circuit diagram illustrating the filament simulation circuit according to a first embodiment of the invention.

FIG. 4(A) is a detailed circuit diagram illustrating the filament simulation circuit 1 according to a first embodiment of the invention. In this embodiment, the first filament simulation part 11 and the second filament simulation part 12 are of the same structure, and are respectively disposed on two terminals of the LED tube 2. Besides, the first sub-filament simulation part 13 of the first filament simulation part 11, the second sub-filament simulation part 14 of the first filament simulation part 11, the third sub-filament simulation part 15 of the second filament simulation part 12, and the fourth sub-filament simulation part 16 of the second filament simulation part 11 are of the same structure, and thus only the first sub-filament simulation part 13 is described in details hereinafter.

The first sub-filament simulation part 13 includes a first resistor R1, a capacitor C1 and an inductor L1, and is divided into a first part 17 and a second part 18 connected in series to the first part 17. The first resistor R1 is disposed on the first part 17, and the capacitor C1 and the inductor L1 are disposed on the second part 18. Besides, the first sub-filament part 13 is further provided with a second resistor R2 disposed on the second part 18.

The second resistor R2 is disposed on a first path P1 of the second part 18, and the capacitor C1 is connected in series to the inductor L1 on a second path P2 of the second part 18. The first path P1 is connected in parallel to the second path P2, so that the second part 18 is formed to be a parallel-connection structure.

Besides, a first terminal 131 of the first sub-filament simulation part 13 is used to receive an external current, and a second terminal 132 of the first sub-filament simulation part 13 is connected in series to the second sub-filament simulation part 14. It is noted that, in this embodiment, the first part 17 of the first sub-filament simulation part 13 is adjacent to the first terminal 131, and the second part 18 is adjacent to the second terminal 132, but in other embodiments, the positions of the first part 17 and the second part 18 may be exchanged. In addition, the positions of the capacitor C1 and the inductor L1 on the second path P2 can also be exchanged.

Figure 4B:
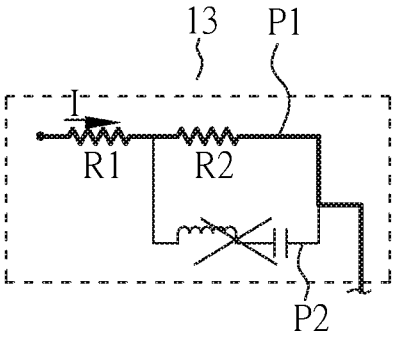
FIG. 4(B) is a schematic diagram illustrating a first status of a first sub-filament simulation part in an identifying stage according to the first embodiment of the invention.

FIG. 4(B) is a schematic diagram illustrating a first status of the first sub-filament simulation part 13 in the identifying stage. In the first status, the LED tube 2 is connected to the electronic ballast 3 of the first type. With reference to FIGS. 3(A) and 4(B), in the identifying stage, the electronic ballast 3 outputs the direct current I. When the direct current I flows through the LED tube 2, the capacitor C1 on the second path P2 generates a high impedance, and the second path P2 is formed as an open circuit. Thus, the electronic ballast 3 detects only the resistances of the first resistor R1 and the second resistor R2 on the first path P1, so that it can identify the LED tube 2 according to the resistances of the first resistor R1 and the second resistor R2.

Figure 4C:
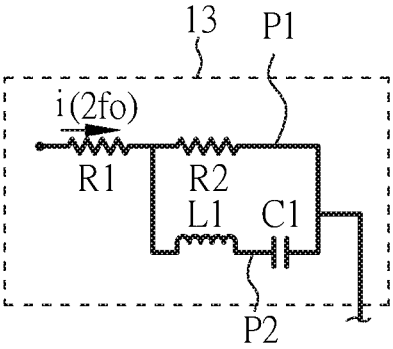
FIG. 4(C) is a schematic diagram illustrating a second status of the first sub-filament simulation part in the identifying stage according to the first embodiment of the invention.

FIG. 4(C) is a schematic diagram illustrating a second status of the sub-filament simulation part 13 in the identifying stage. In the second status, the LED tube 2 is connected to the electronic ballast 3 of the second type. With reference to FIGS. 3(B) and 4(C), in the identifying stage, the electronic ballast 3 outputs an alternating current i with a frequency of 2fo, when the alternating current i flows through the LED tube 2, the capacitor C1 and the inductor L1 are operated normally, and the impedance constituted by the first resistor R1, the capacitor C1, the first inductor L1 and the second resistor R2 can be regarded as a specific impedance, the electronic ballast 3 identifies the LED tube 2 according to the current value corresponding to the specific impedance.

In the pre-heated stage, if the LED tube 2 is connected to the electronic ballast 3 of the first type, the electronic ballast 3 is changed to output the alternating current i, and the capacitor C1 and the inductor L1 are operated normally, so that the current i can flow through the second path P2; if the LED tube 2 is connected to the electronic ballast 3 of the second type, the electronic ballast 3 continues to output the alternating current. Therefore, in the pre-heated stage, no matter whether the LED tube 2 is connected to the electronic ballast 3 of the first type or the second type, the status of the sub-filament simulation part 13 is the same as FIG. 4(C).

Figure 4D:
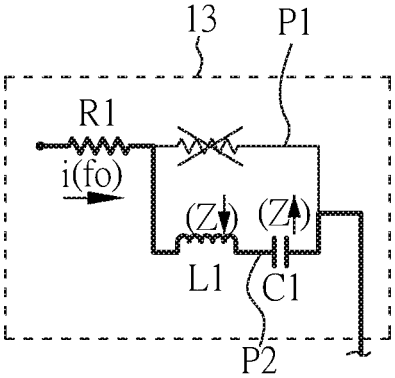
FIG. 4(D) is a schematic diagram illustrating a status of the first sub-filament simulation circuit in an operating stage according to the first embodiment of the invention.

FIG. 4(D) is a schematic diagram illustrating a status of the first sub-filament simulation circuit 13 in the operating stage according to the first embodiment of the invention. When entering the operating stage from the pre-heated stage, the electronic ballast 3 of either the first type or the second type outputs the alternating current i with a frequency lower than that in the pre-heated stage. For example, the frequency of the current i is lowered from 2fo to fo. Because the frequency is lowered, the impedance ZL of the inductor L1 is reduced dramatically according to the impedance characteristic, so that the total impedance of the second path P2 can be reduced. Due to the first path P1 is connected in parallel to the second path P2, the impedance of the second resistor R2 on the first path P1 is extremely higher than the impedance of the second path P2; i.e., the first path P1 can be regarded as an open circuit. Thus, the alternating current i only flows through the first resistor R1 and the second path P2.

Accordingly, in the operating stage, the total impedance of the first sub-filament simulation part 13 is only constituted by the impedances of the first resistor R1, the capacitor C1 and the inductor L1, so that the total power consumption of the filament simulation circuit 1 can be reduced.

With reference to FIGS. 4(A) to 4(D), it is noted that, when the frequency of the alternating current is lowered, the impedance of the inductor L1 is reduced, but the impedance of the capacitor C1 is increased, so that the capacitor C1 and the inductor L1 should be configured as: when entering the operating stage from the pre-heated stage, an impedance variation of the capacitor C1 is smaller than that of the inductor L1.

Besides, the resistance of the second resistor R2 is preferred to be greater than that of the first resistor R1, so that, in the operating stage, the impedance constituted by the resistors can be extremely reduced.

In addition, by disposing both of the capacitor C1 and the inductor L1 in the filament simulation circuit 1, the capacitor C1 and the inductor L1 can compensate for each other, so that the current and the voltage applied to the filament simulation circuit 1 can be kept to be in-phase.

Figure 5A:
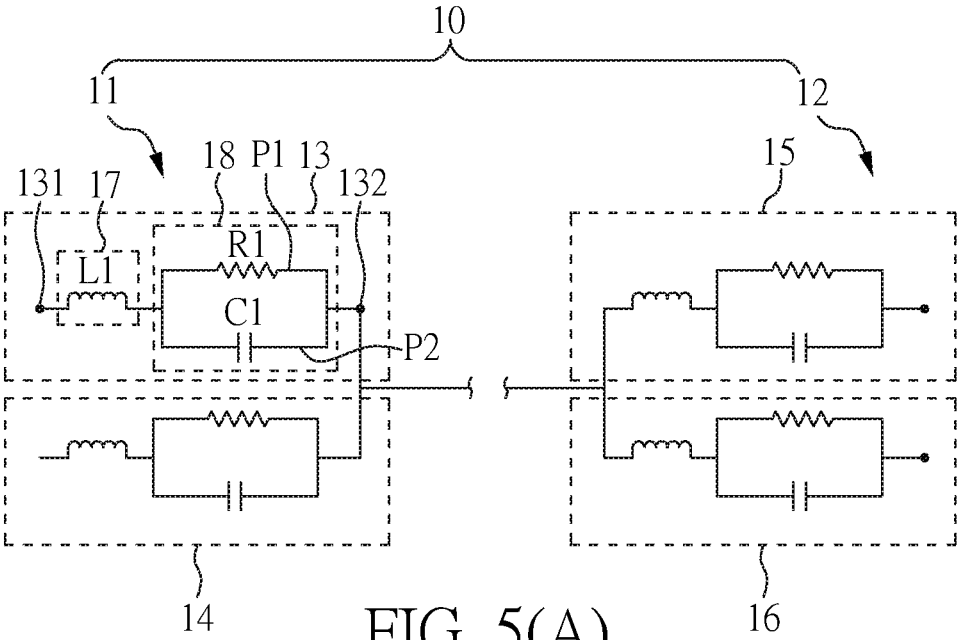
FIG. 5(A) is a detailed circuit diagram of the filament simulation circuit according to a second embodiment of the invention.

FIG. 5(A) is a detailed circuit diagram illustrating the filament simulation circuit 1 according to a second embodiment of the invention. Similar to the first embodiment, in this embodiment, the first filament simulation part 11 and the second filament simulation part 12 are also of the same structure. Besides, the first sub-filament simulation part 13 of the first filament simulation part 11, the second sub-filament simulation part 14 of the first filament simulation part 11, and the third sub-filament simulation part 15 of the second filament simulation part 12 and the fourth sub-filament simulation part 16 of the second filament simulation part 11 are of same structures, and thus only the first sub-filament simulation part 13 is described in details hereinafter.

Similarly, a first filament simulation part 13 includes a first resistor R1, a capacitor C1 and an inductor L1, and is divided into a first part 17 and a second part 18. The inductor L1 is disposed on the first part 17, and the capacitor C1 and the first resistor R1 are disposed on the second part 18. Further, the first resistor R1 is disposed on a first path P1 of the second part 18, and the capacitor C1 is disposed on a second path P2 of the second part 18. The first path P1 is connected in parallel to the second path P2, and the second part 18 is connected in series to the first part 17.

Similarly, the first terminal 131 of the first sub-filament simulation part 13 is used to receive an external current, and a second terminal 132 of the first sub-filament simulation part 13 is connected in series to the second sub-filament simulation part 14. It is noted that the positions of the first part 17 and the second part 18 can be exchanged.

Figure 5B:
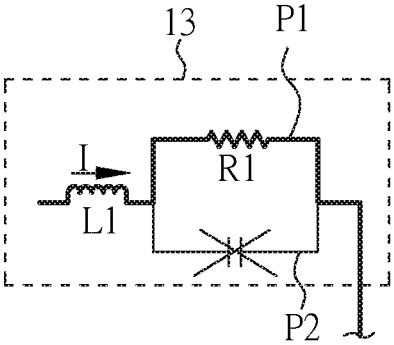
FIG. 5(B) is a schematic diagram illustrating a first status of a first sub-filament simulation part in an identifying stage according to the second embodiment of the invention.

FIG. 5(B) is a schematic diagram illustrating a first status of the first sub-filament simulation part 13 in the identifying stage. In the first status, the LED tube 2 is connected to the electronic ballast 3 of the first type (outputting a direct current I). With reference to FIGS. 3(A) and 5(B), the electronic ballast 3 outputs a direct current I in the identifying stage and, when the direct current I flows through the LED tube 2, the impedance of the inductor L1 of the first part 17 is extremely low according to the inductor characteristic, so that the first part 17 can be regarded as a short circuit, while the impedance of the capacitor C1 of the second part 18 is extremely high according to the capacitor characteristic, so that the second path P2 can be regarded as an open circuit. Thus, the electronic ballast 3 can correctly detect the resistance of the first resistor R1 on the first path P1, and so as to identify the LED tube 2 according to the resistance of the first resistor R1.

Figure 5C:
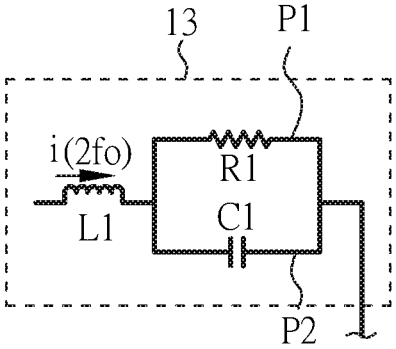
FIG. 5(C) is a schematic diagram illustrating a second status of the first sub-filament simulation part in the identifying stage according to the second embodiment of the invention.

FIG. 5(C) is a schematic diagram illustrating a second status of the filament simulation circuit 1 in the identifying stage according to the second embodiment of the invention. In the second status, the LED tube 2 is connected to the electronic ballast 3 of the second type (outputting an alternating current i. With reference to FIGS. 3 (A) and 5(C), the electronic ballast 3 outputs an alternating current i in the identifying stage and, when the alternating current i flows through the LED tube 2, the capacitor C1 and the inductor L1 can be operated normally, and the capacitor C1, the inductor L1 and the first resistor R1 constitute a specific impedance, so that the electronic ballast 3 can identify the LED tube 2 according to the current value corresponding to the specific impedance.

In the pre-heated stage, if the LED tube 2 is connected to the electronic ballast 3 of the first type, the electronic ballast 3 is changed to output the alternating current i with a frequency of 2fo, and the capacitor C1 and the inductor L1 are operated normally, so that the current i can flow through the second path P2; if the LED tube 2 is connected to the electronic ballast 3 of the second type, the electronic ballast 3 continues to output the alternating current i with a frequency of 2fo. Therefore, in the pre-heated stage, the status of the filament simulation circuit 1 is the same as FIG. 5(C).

Figure 5D:
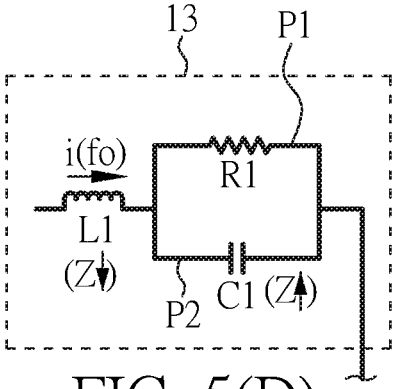
FIG. 5(D) is a schematic diagram illustrating a status of the first sub-filament simulation circuit in an operating stage according to the second embodiment of the invention.

FIG. 5(D) is a schematic diagram illustrating a status of the first sub-filament simulation circuit 13 in the operating stage according to the second embodiment of the invention. When entering the operating stage from the pre-heated stage, due to the frequency of the alternating current outputted from the electronic ballast 3 is lowered, the impedance of the inductor L1 is reduced according to the inductor characteristic, and the impedance of the capacitor C1 is increased according the capacitor characteristics. Corresponding to the increased impedance Zc of the capacitor C1, the current flowing through the second path P2 is also increased, and the current flowing through the first resistor R1 is reduced due to the first resistors R1 being connected in parallel to the capacitor C1 in the second part P2. Thus the total power consumption of the filament simulation circuit 1 can be reduced.

With reference to FIGS. 5(A) to 5(D), it is noted that, in the operating stage, the impedance of the capacitor C1 should be smaller than that of the first resistor R1, so that a part of the current flowing through the first path P1 can be diverted to the second path P2. Thus, the power consumption of the first resistor R1 of the filament simulation circuit 1 can be reduced.

Besides, when the filament simulation circuit 1 generates an oscillation in the operating stage, the first resistor R1 can consume the power generated by the oscillation so as to prevent the power generated by the oscillation from influencing the operation of the filament simulation circuit 1.

In addition, by disposing both of the capacitor C1 and the inductor L1 in the filament simulation circuit 10, the capacitor C1 and the inductor L1 can compensate for each other, so that the current and the voltage applied to the filament simulation circuit 10 can be kept to be in-phase.

In Summary, the filament simulation circuit of the invention comprises the resistors, the capacitors and the inductors at the same time for providing various effects through specific connections. In the identifying stage, the electronic ballast that outputs the direct current can identify the LED tube according to the resistance, and the electronic ballast that outputs the alternating current can identify the LED tube according the current value corresponding to the impedance constituted by the resistors, the capacitors and the inductors. In the operating stage, based on the feature that the impedances of the capacitors and the inductors are changed according to the variation of the current frequency, the value of the current flowing through the resistors can be reduced, thereby reducing the total power consumption.

Although the present invention has been explained in relation to its preferred embodiments, it is to be understood that many other possible modifications and variations can be made without departing from the spirit and scope of the invention as hereinafter claimed.

What is claimed is:

1. A filament simulation circuit for LED tube, comprising:

two filament simulation parts respectively disposed on two terminals of a tube to receive a current from an electronic ballast, each filament simulation part including two sub-filament simulation parts, each sub-filament simulation part including a first resistor, a capacitor and an inductor, wherein each sub-filament simulation part is divided into:

a first part; and a second part connected in series to the first part, the second part having a parallel connection structure;

wherein an impedance of the sub-filament simulation part in a pre-heated stage is greater than that in an operating stage.

2. The filament simulation circuit for LED tube of claim 1, wherein the first part of each sub-filament simulation part includes the first resistor.

3. The filament simulation circuit for LED tube of claim 2, wherein the second part of each sub-filament simulation part includes the capacitor and the inductor.

4. The filament simulation circuit for LED tube of claim 3, wherein the second part of each sub-filament simulation part includes a second resistor disposed on a first path.

5. The filament simulation circuit for LED tube of claim 4, wherein the capacitor is connected in series to the inductor on a second path, and the second path is connected in parallel to the first path.

6. The filament simulation circuit for LED tube of claim 5, wherein in an identifying stage, when the current from the electronic ballast is DC current, the impedance of the sub-filament simulation part is resulted from the first resistor and the second resistor.

7. The filament simulation circuit for LED tube of claim 5, wherein in an identifying stage, when the current from the electronic ballast is AC current, the impedance of the sub-filament simulation part is resulted from the first resistor, the second resistor, the capacitor and the impedance.

8. The filament simulation circuit for LED tube of claim 5, wherein in the operating stage, the impedance of the sub-filament simulation part is resulted from the first resistor, the capacitor and the inductor.

9. The filament simulation circuit for LED tube of claim 5, wherein from the pre-heated stage to the operating stage, an impedance variation of the capacitor is smaller than that of the inductor.

10. The filament simulation circuit for LED tube of claim 5, wherein a resistance of the first resistor is smaller than that of the second resistor.

11. The filament simulation circuit for LED tube of claim 1, wherein the first part of each sub-filament simulation part includes the inductor.

12. The filament simulation circuit for LED tube of claim 11, wherein the second part of each sub-filament simulation part includes the first resistor and the capacitor.

13. The filament simulation circuit for LED tube of claim 11, wherein the first resistor is connected in parallel to the capacitor.

14. The filament simulation circuit for LED tube of claim 13, wherein in an identifying stage, when the current from the electronic ballast is DC current, the impedance of the sub-filament simulation part is resulted from the first resistor.

15. The filament simulation circuit for LED tube of claim 13, wherein in an identifying stage, when the current from the electronic ballast is AC current, the impedance of the sub-filament simulation part is resulted from the first resistor, the capacitor and the inductor.

16. The filament simulation circuit for LED tube of claim 13, wherein in the operating stage, the impedance of the sub-filament simulation part is resulted from the inductor, the capacitor and the first resistor.

17. The filament simulation circuit for LED tube of claim 16, wherein an impedance of the capacitor is smaller than that of the first resistor.

18. The filament simulation circuit for LED tube of claim 1, wherein a frequency of the current from the electronic ballast in the pre-heated stage is higher than that in the operating stage.

* * * * *